US006308038B1

(12) United States Patent
Kakeshita et al.

(10) Patent No.: US 6,308,038 B1
(45) Date of Patent: Oct. 23, 2001

(54) DEVELOPING APPARATUS

(75) Inventors: Tomomi Kakeshita; Yasuyuki Ishii, both of Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/614,384

(22) Filed: Jul. 11, 2000

(30) Foreign Application Priority Data

Jul. 13, 1999 (JP) ..... 11-198750

(51) Int. Cl.[7] ..... G03G 15/08
(52) U.S. Cl. ..... 399/286; 399/279; 399/284
(58) Field of Search ..... 399/252, 265, 399/279, 284, 286; 430/109, 111, 120

(56) References Cited

U.S. PATENT DOCUMENTS 4,746,589 * 5/1988 Haneda et al. ..... 430/120
4,827,868 * 5/1989 Tarumi et al. ..... 399/286
5,752,146 * 5/1998 Sato ..... 399/284
5,797,070 * 8/1998 Waki et al. ..... 430/109
5,867,755 * 2/1999 Sato ..... 399/279 X

FOREIGN PATENT DOCUMENTS 36-10231 7/1936 (JP) .
59-53856 3/1984 (JP) .

* cited by examiner

*Primary Examiner*—Sandra Brase
(74) *Attorney, Agent, or Firm*—Fitzpatrick, Cella, Harper & Scinto

(57) ABSTRACT

A developing apparatus has a developer carrying body carrying a developer thereon, and a layer thickness regulating member for regulating the layer thickness of the developer carried on the developer carrying body. The developer carried on the developer carrying body contacting with an image bearing body after the layer thickness thereof has been regulated by the layer thickness regulating member. In the developing apparatus, when the charge amount per 1 g of the developer after the layer thickness has been regulated by the layer thickness regulating member and before the developer contacts with the image bearing body is defined as Q ($\mu$C/g) and the electrical resistance per axial length 1 mm of the developer carrying body is defined as R (Ω/mm), $$R \geqq 0.9\times(-7.83\times10^{4}|Q|+7.05\times10^{6})$$

and $$R \leqq 1.1\times(-7.83\times10^{4}|Q|+7.05\times10^{6})$$

are satisfied.

12 Claims, 4 Drawing Sheets

DEVELOPING APPARATUS

BACKGROUND OF THE INVENTION

1. Field of the Invention

This invention relates to a developing apparatus provided in an image forming apparatus such as a copier of the electro-photographic type or a printer.

2. Related Background Art

In the field of an image forming apparatus of the electro-photographic type, there is known and put into practical use an image forming apparatus in which an electrical latent image is formed on a photosensitive body which is a latent image bearing body utilizing a photoconductive substance by one of various methods, and then the latent image is developed by a developing apparatus with a toner which is a developer and is visualized as a toner image, and as required, the toner image is transferred to a transferring material which is a recording medium such as paper, whereafter heat and pressure or the like are imparted to the toner image to thereby fix the toner image and obtain a copy.

In such an image forming apparatus, however, improvements in the resolution, definition, etc. of image are now required and the development of a method of and an apparatus for forming a thin layer of toner on a developer carrying body provided in the developing apparatus is requisite, and several measures for this have been proposed.

In recent years, in such an image forming apparatus, there has been proposed a contact monocomponent developing method which adopts a semiconductive developing roller or a developing roller having a dielectric layer formed on the surface thereof as a developer carrying body carrying a developer thereon and in which this developing roller is urged against the surface layer of the photosensitive body with the developer interposed therebetween to thereby effect developing.

In this contact monocomponent developing method, developing is effected with the developing roller abutting against or brought into pressure contact with the photosensitive body bearing the electrostatic latent image thereon and therefore, it is necessary to use a developing roller having elasticity.

Particularly, when the developing roller is to be brought into contact with a latent image bearing body comprising a rigid body, it becomes a requisite condition to use a developing roller having elasticity in order to avoid injuring the latent image bearing body.

In such an image forming apparatus, however, the non-magnetic monocomponent DC contact developing method according to the prior art suffers from the following problem.

When an electrically conductive developing roller is used, an electric current is created in the nip portion between the photosensitive body and the developing roller by the movement of the toner having charges, and developing is effected even at a low developing potential difference (the difference between the surface potential of the electrostatic latent image bearing body and the developing bias potential) and high image density is obtained.

Thus, there results image formation having a high γ value, and the γ value of developing obtained from the inclination of a curve resulting from output image density having been plotted relative to the developing potential difference becomes high, and it has been difficult to faithfully reproduce a halftone image conforming to the continuous image density of an original.

SUMMARY OF THE INVENTION

It is an object of the present invention to provide a developing apparatus which can obtain images of excellent gradation.

It is also an object of the present invention to provide a developing apparatus comprising:

a developer carrying body for carrying a developer thereon; and a layer thickness regulating member for regulating a layer thickness of the developer carried on the developer carrying body, the developer carried on the developer carrying body contacting with an image bearing body after the layer thickness thereof is regulated by the layer thickness regulating member;

wherein when a charge amount per 1 g of the developer after the layer thickness is regulated by the layer thickness regulating member and before the developer contacts with an image bearing body is defined as Q ($\mu$ C/g) and the electrical resistance per axial length 1 mm of the developer carrying body is defined as R (Ω/mm), $$R \geqq 0.9 \times (-7.83 \times 10^4 |Q| + 7.05 \times 10^6)$$

and $$R \leqq 1.1 \times (-7.83 \times 10^4 |Q| + 7.05 \times 10^6)$$

are satisfied.

Other objects and features of the present invention will become more fully apparent from the following detailed description when read with reference to the accompanying drawings.

DESCRIPTION OF THE PREFERRED EMBODIMENT

An embodiment of the present invention will hereinafter be described with reference to the accompanying drawings.

Figure 1:
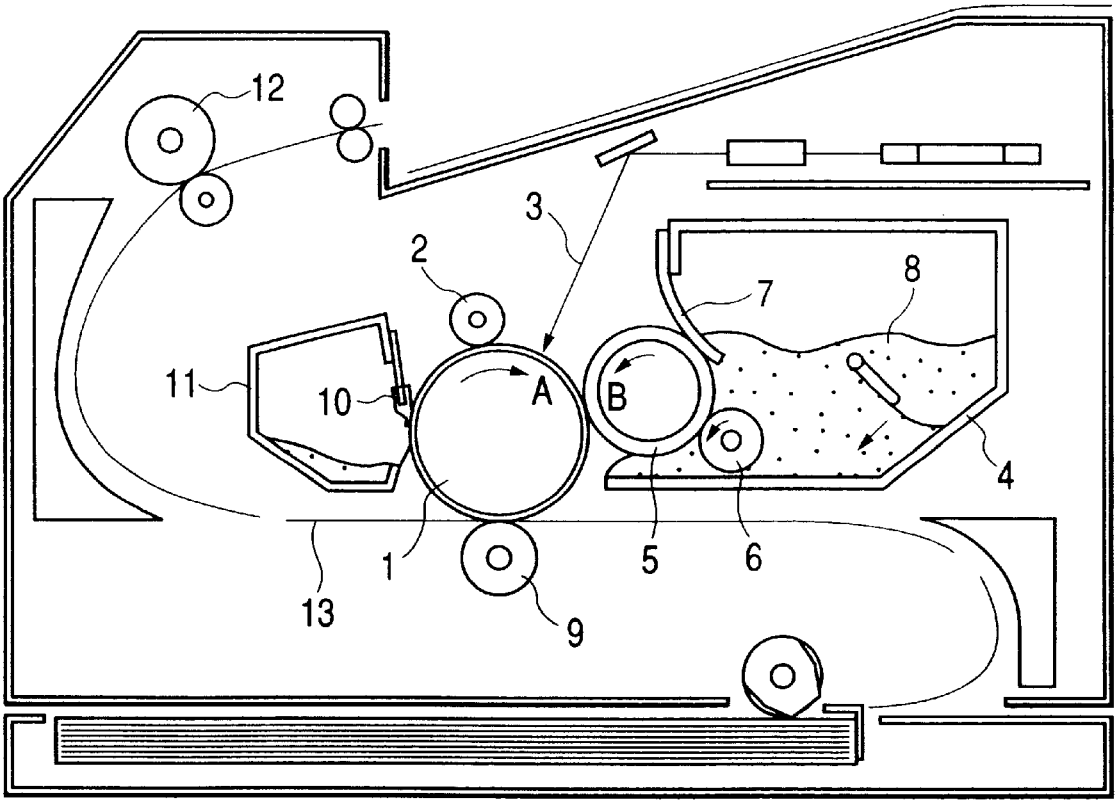
FIG. 1 is a cross-sectional view schematically showing the construction of an image forming apparatus provided with a developing apparatus according to an embodiment of the present invention.
Figure 2:
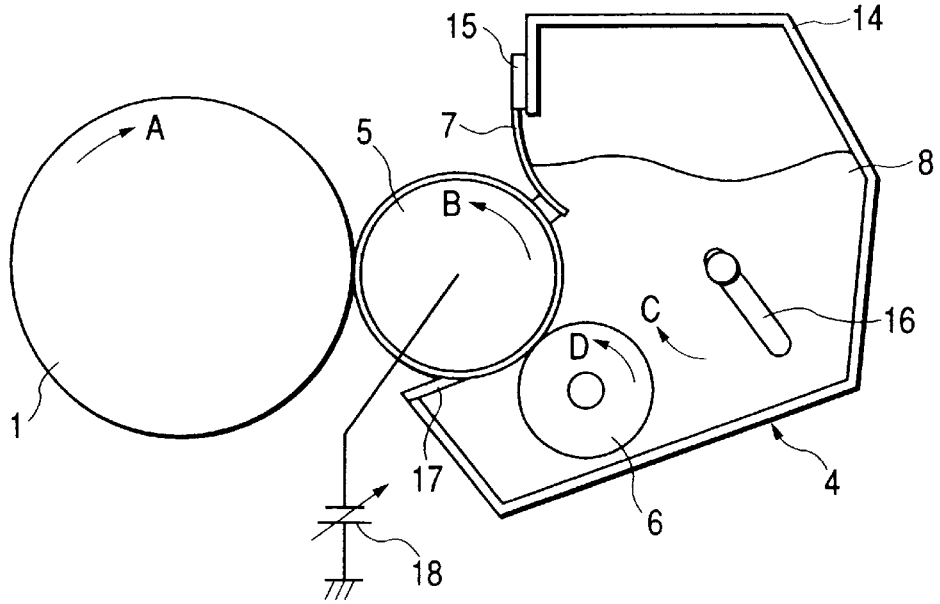
FIG. 2 is a cross-sectional view schematically showing the construction of the developing apparatus provided in the image forming apparatus of FIG. 1.

FIG. 1 is a cross-sectional view schematically showing the construction of an image forming apparatus according to the present embodiment, and FIG. 2 is a cross-sectional view schematically showing the construction of a developing apparatus provided in the image forming apparatus of FIG. 1.

In such an image forming apparatus, as shown in FIG. 1, a photosensitive drum 1 as a latent image bearing body is first rotated in the direction of arrow A, and is uniformly charged by a charging apparatus 2 for charging the photosensitive drum 1, and an electrostatic latent image is formed on the surface of the photosensitive drum 1 by a laser beam 3 which is exposing means for writing an electrostatic latent image on the photosensitive drum 1.

The electrostatic latent image is developed by a toner which is a developer being imparted thereto by a developing apparatus held in a process cartridge (not shown) disposed in proximity to the photosensitive drum 1 and detachably attachable to the main body of the image forming apparatus, and is visualized as a toner image.

In the present embodiment, the so-called reversal developing for forming a toner image in an exposing portion is effected.

The visualized toner image on the photosensitive drum 1 is transferred to paper 13 which is a recording medium by a transferring roller 9.

The paper 13 to which the toner image has been transferred is subjected to the fixing process by a fixing apparatus 12, and is discharged out of the apparatus, and thus the printing operation is completed.

On the other hand, the transfer residual toner not transferred but remaining on the photosensitive drum 1 is scraped off by a cleaning blade 10 and is contained in a waste toner container 11, and the cleaned photosensitive drum 1 repetitively effects the above-described action.

The developing apparatus 4 according to the present embodiment will further be described with reference to FIG. 2.

Figure 4:
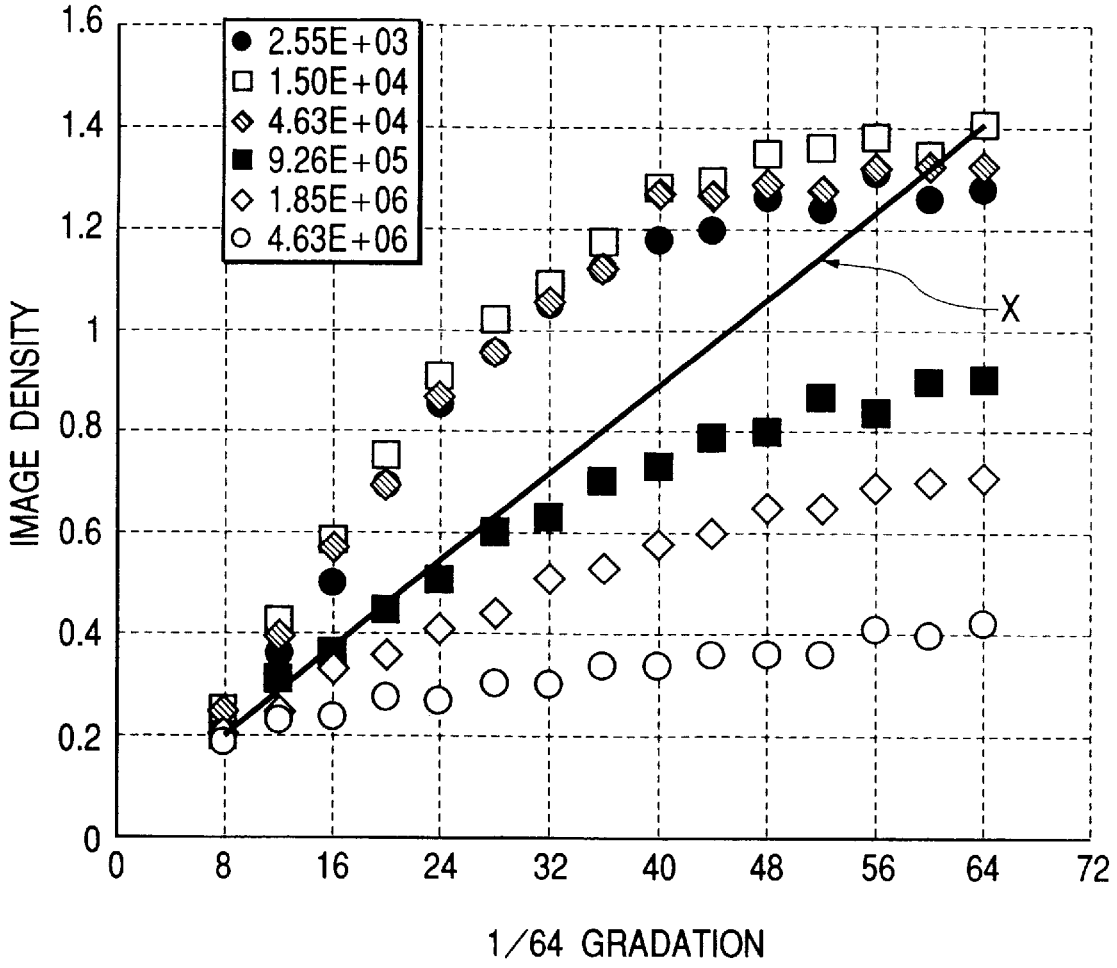
FIG. 4 is a graph showing the gradation curve of an image outputted at 1200 dpi dither 64 gradation in the embodiment of the present invention.

The developing apparatus 4, as shown in FIG. 4, is provided with a developing container 14 containing therein a nonmagnetic toner 8 as a monocomponent developer, and a developing roller 5 as a developer carrying body positioned in an opening portion extending in the lengthwise direction in the developing container 14 and disposed in opposed relationship with the photosensitive drum 1, and is adapted to develop and visualize the electrostatic latent image on the photosensitive drum 1.

A toner layer carried on the developing roller 5 is in contact with the photosensitive drum 1 with an abutting width.

In the developing apparatus 4, an elastic roller 6 abuts against the upstream side of the abutting portion of an elastic blade 7 against the surface of the developing roller 5 with respect to the direction of rotation of the developing roller 5 and is rotatably supported, in the developing container 14.

As the structure of the elastic roller 6, a foamed skeletal sponge structure or fur brush structure comprising fibers of rayon, nylon or the like implanted on a mandrel is preferable from the viewpoint of supplying the toner 8 to the developing roller 5 and scraping the undeveloped toner.

In the present embodiment, use is made of an elastic roller 6 of a diameter 16 mm having polyurethane foam provided on a mandrel comprising a metal shaft.

As the abutting width of this elastic roller 6 against the developing roller 5, 1 to 8 mm is effective, and it is preferable to give a relative speed to the developing roller 5 in the abutting portion, and in the present embodiment, the abutting width is set to 3 mm, and the elastic roller 6 is rotatively driven at predetermined timing by driving means (not shown) so that the peripheral speed of the elastic roller 6 may be 50 mm/s ( the relative speed to the developing roller 5 being 130 mm/s) during the developing operation.

On the downstream side of the elastic roller 6 with respect to the direction of rotation of the developing roller 5, the elastic blade 7 is supported by a blade supporting metal plate 15, and is provided so that the vicinity of the free end thereof may abut against the outer peripheral surface of the developing roller 5 in surface contact.

The elastic blade 7 comprises a rubber material such as silicone or urethane, or a thin metal plate of SUS or phosphor bronze having spring elasticity as a base body and a rubber material adhered to the abutting surface thereof against the developing roller 5.

Also, the abutting direction of the elastic blade 7 against the developing roller 5 is the so-called counter direction in which, the tip end side thereof is positioned upstream of the abutting portion with respect to the direction of rotation of the developing roller 5.

In the present embodiment, the elastic blade 7 is of a construction in which a urethane rubber plate having a thickness of 1.0 mm adhered to the blade supporting metal plate 15.

Also, the abutting pressure of the elastic blade 7 against the developing roller 5 was set to 25 to 35 g/cm (the measurement of line pressure is effected by converting from a value at which three metal thin plats of a known coefficient of friction were inserted into the abutting portion and the central one of them was drawn out by a spring balance).

Figure 3:
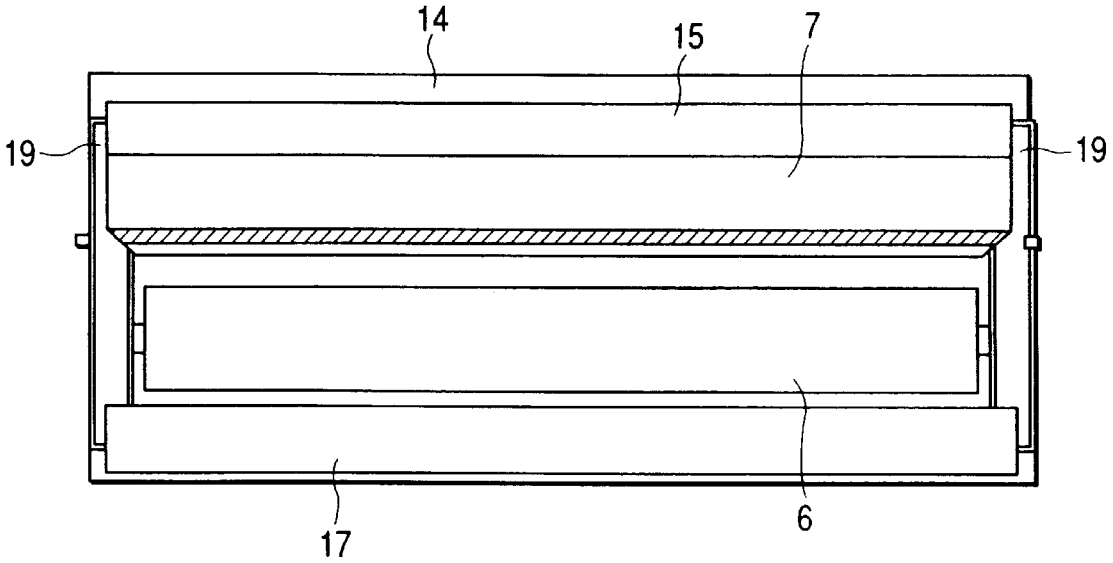
FIG. 3 is a view of the developing apparatus of FIG. 2 as it is seen from the latent image bearing body side.

FIG. 3 is a view of the developing apparatus 4 of FIG. 2 as it is seen from the direction of the photosensitive drum 1, and for the convenience of illustration, the developing roller 5 is not shown.

In order to prevent the leakage of the toner from both end portions of the developing roller 5, end portion seal members 19 are provided in the opening portions of the developing container 14, and seal the space between the axially both end portions of the developing roller 5 and the opening portions of the developing container 14.

The elastic blade 7, as shown in FIG. 3, is constructed so that the distance from the abutting nip thereof with the developing roller 5 indicated by hatching to the tip end of the elastic blade 7 may become continuously shorter from the ordinary developing area toward the opposite end portions of the elastic blade 7.

Further, the blade tip end position at the both end portions of the elastic blade 7 in the axial direction of the developing roller 5 is designed to be within the above-mentioned abutting nip.

That is, the thickness of the toner layer formed on the developing roller 5 is affected by the distance from an upstream point of the abutting nip with respect to the direction of rotation of the developing roller 5 to the tip end thereof, and as is heretofore known, the longer becomes this distance, the thicker becomes the toner layer formed on the developing roller 5, and the shorter becomes this distance, the thinner becomes the toner layer.

The toner 8 is a nonmagnetic monocomponent developer and as described above, use is made of a toner which is excellent in transferability and high in the lubricating property when the transfer residual toner not transferred but remaining on the photosensitive drum 1 is removed by cleaning means such as a blade or a fur brush and therefore has the advantage that the wear of the photosensitive drum 1 is small, i.e., a toner which is spherical and has a smooth surface.

Specifically, the volume resistance value of the toner is $10^{14}\Omega$ or greater, and as measuring conditions, a weight having a measuring electrode plate area of diameter of 6 mm ($\phi$ 6 mm) and 0.238 $cm^2$, pressure of 1500 g is used to measure pressure of 980 $gf/cm^2$ (96.1 kPa), and the thickness of the powder layer during measurement 0.5 to 1.0 mm are set, and a DC voltage of 400 V is applied to measure the amount of current by a minute ammeter (YHP 4140 pA METER/DC VOLTAGE SOURCE), and the volume resistance value (specific resistance) is calculated from the resistance value.

As the toner in the present embodiment, use is made of one in which as shape factors, $SF_1$ is 100 to 180 and $SF_2$ is 100 to 140.

As these $SF_1$ and $SF_2$, values obtained by sampling 100 toner images at random by the use of FE-SEM (S-800) produced by Hitachi, Ltd., introducing the image information thereof into an image analyzing apparatus (Luzex 3) produced by Nicolet Japan Corporation through an interface and effecting analysis, and calculating from the following expressions are defined.

$$SF_1=\{(\mathrm{MXLNG})^2/\mathrm{AREA}\}\times(\pi/4)\times 100$$

$$SF_2=\{(\mathrm{PERI})^2/\mathrm{AREA}\}\times(1/4\pi)\times 100$$

(AREA: toner projection area, MXLNG: absolute maximum length of toner, PERI: peripheral length of toner)

The shape factor $SF_1$ of this toner indicates the degree of sphericity, and as it becomes greater from 100, the shape gradually becomes from sphericity to an amorphous shape, and $SF_2$ indicates the degree of unevenness, and as it becomes greater from 100, the unevenness of the surface of the toner becomes remarkable.

As a method of manufacturing the toner, it is possible to manufacture the toner by the use of a method of directly producing a toner by the use of a suspension polymerizing method described in Japanese Patent Application Laid-Open No. 36-10231 or Japanese Patent Application Laid-Open No. 59-53856, a dispersion polymerizing method of directly producing a toner by the use of a water organic solvent soluble in a monomer but in which an obtained polymer is insoluble, or an emulsion polymerizing method typified by a soap-free polymerizing method of producing a toner by directly polymerizing under the presence of a water soluble polarity polymerization starting agent, besides a manufacturing method using the so-called crushing method, if within the range of the above-described shape factors.

In the present embodiment, the shape factor $SF_1$ and $SF_2$ of the toner can be controlled easily to 100 to 180 and 100 to 140, respectively, and, by the use of the suspension polymerizing method under normal pressure or under pressure whereby there can be relatively easily obtained a fine particle toner having a shape particle size distribution and having a particle diameter of 4 to 8 $\mu$m, styrene and n-butyl acrylate as monomers a metal salicylate compound as a charge controlling agent, saturated polyester as polarity resin and further, a coloring agent were added to thereby manufacture colored suspension particles having a weight average particle diameter of 7 $\mu$m.

Hydrophobic silica was extraneously added thereto by 1.5 wt %, whereby there was manufactured the toner 8 of the negative polarity which was excellent in transferability and by which the wear of the photosensitive drum 1 during the cleaning thereof was small, as described above.

In the above-described developing apparatus 4, during the developing operation thereof, the toner 8 in the developing container 14 is sent toward the elastic roller 6 with the rotation of an agitating member 16 in the direction of arrow C.

Next, the toner 8 is carried to the vicinity of the developing roller 5 by the elastic roller 6 being rotated in the direction of arrow D, and in the nip portion between the developing roller 5 and the elastic roller 6, the toner 8 carried on the elastic roller 6 frictionally contacts with the developing roller 5, whereby it is subjected to frictional charging and adheres onto the developing roller 5.

Thereafter, the toner 8 adhering onto the developing roller 5 is sent under the pressure contact of the elastic blade 7 with the rotation of the developing roller 5 in the direction of arrow B, and a thin layer of the toner 8 is formed on the developing roller 5.

In the present embodiment, −40 to −20 $\mu$C/g, 0.4 to 1.0 mg/cm$^2$ and 10 to 20 $\mu$m are set so as to be obtained as a good amount of charging, a good amount of toner coat and a toner layer thickness, respectively. When the amount of charging of the toner is to be measured, the amount of charging of the toner after the toner on the developing roller 5 is subjected to the pressure contact by the elastic blade and before it comes to the opposed portion of the photosensitive drum 1 and the developing roller 5 is measured.

Also, the developing roller 5 has its right substantially half peripheral surface plunged into the developing container 14 in the above-described opening portion, and has its left substantially half peripheral surface exposed out of the developing container 14.

That surface portion of the developing roller 5 which is exposed out of the developing container 14 is in contact with and opposed to the photosensitive drum 1 positioned at the left of the developing apparatus 4.

The developing roller 5 is rotatively driven in the direction of arrow B, and the surface thereof has moderate unevenness for enhancing the probability of frictional contact with the toner 8 and effecting the carrying of the toner 8 well, and in the present embodiment, an elastic roller 6 coated with acryl-urethane resin on a silicone rubber layer having a diameter of 16 mm, a length of 216 mm and a thickness of 5 mm is used as the developing roller.

Also, the developing roller 5 is in pressure contact with the photosensitive drum 1 and is rotated at a peripheral speed of 80 mm/s somewhat higher than the peripheral speed of 50 mm of the photosensitive drum 1.

The resistance $R_1$ Ω/mm of the developing roller will be defined here.

For the measurement of the resistance value of the developing roller, an aluminum roller (aluminum elementary tube) having a diameter of 30 mm and the developing roller are made to abut against each other with an abutting load 500 gF ($500\times10^{-3}\times9.8=4.9$ N), and the aluminum roller is rotated at a peripheral speed of 50 mm/s.

Next, a resistor of 10 k to 10 MΩ is disposed on the earth side, a DC voltage of 400 V is applied to the developing roller, the voltage across it is measured, the electric current thereof is calculated and the actually measured resistance value $R_0$Ω is found.

A value obtained by converting the resistance of the developing roller per 1 mm in the lengthwise direction (axial direction) thereof was then defined as the resistance $R_1$ Ω/mm of the developing roller.

A description will now be provided of the result obtained by preparing several kinds of developing rollers of which the resistance values have been varied to obtain the optimum value of the resistance value of the developing roller, and comparing image characteristics obtained by the use thereof.

Each developing roller was installed in the developing device, as shown in FIG. 2, to thereby obtain a dither 64 gradation image.

The developing conditions were as follows.

Surface potential of the unexposed portion of the photosensitive body: −600 V

Developing bias potential: −300 V

Toner charging amount: −60.0 μC/g, −30.0 μC/g, −15.0 μC/g

Amount of toner adhering onto the developing roller: 0.4 mg/cm$^2$

Resistance $R_1$ of the developing roller: $2.55\times10^3$ Ω/mm, $1.50\times10^4$ Ω/mm, $4.63\times10^4$ Ω/mm, $1.00\times10^5$ Ω/mm, $9.26\times10^5$ Ω/mm, $1.85\times10^6$ Ω/mm, $4.63\times10^6$ Ω/mm Next, a predetermined bias was applied to the developing roller, the toner image formed on the photosensitive body was transferred to plain paper and fixed to thereby obtain an image, and the image density of the obtained image was measured by Macbeth's reflection density meter (RD918), and was defined as the image density of the output image.

The gradation curve of an image outputted at 1200 dpi dither 64 gradation is referred to as the γ characteristic of developing, and the γ characteristic when the amount of charging of the toner is −30.0 μC/g is shown in FIG. 4.

The curves in FIG. 4 represent the gradation characteristics of images outputted by the developing rollers differing in resistance, and a straight line X is a straight line in which the γ characteristic was subjected to primary recursion and the inclination thereof is 0.02, and this straight line X represents an ideal γ characteristic.

The inclination of the γ curve is referred to as γ value is allowed if it is ±10%, that is, within the range of γ=0.018 to 0.022.

From this, it will be seen that the gradation is greatly varied by the resistance of the developing roller.

Figure 5:
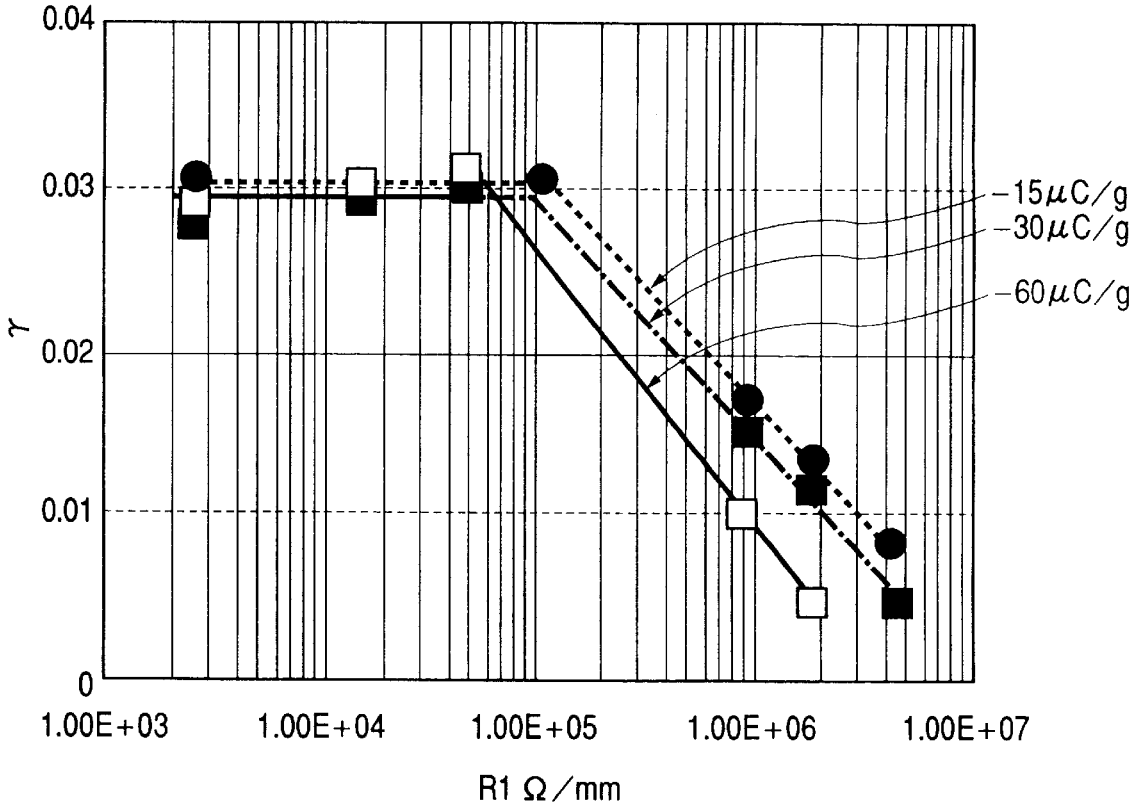
FIG. 5 is a graph showing the relation between the γ value by FIG. 4 and the resistance value of a developing roller in the embodiment of the present invention.

FIG. 5 shows the relation between the γ values and the resistance of the developing roller when the amount of charging of the toner found in FIG. 4 is −30 μC/g and when it is −60.0 μC/g and −15.0 μC/g.

From this, the γ value does not change when the resistance of the developing roller is $5\times10^5$ Ω/mm or less, but thereafter the γ value and the resistance are proportional to each other.

The relations between the resistance $R_1$ and the amount of charging Q of the toner when γ value=0.02 are as follows, and it has been found that the output image in this case exhibits excellent gradation.

$$(R_1, Q, \gamma)=(5.9\times10^6, -15, 0.02)$$

$$(R_1, Q, \gamma)=(4.7\times10^6, -30, 0.02)$$

$$(R_1, Q, \gamma)=(2.4\times10^6, -60, 0.02)$$

From this, it will be seen that the amount of charging of the toner and the resistance $R_1$ of the developing roller are in a linear relation.

From this, it has been formed that the following expression is satisfied.

$$R_1=-7.83\times10^4|Q|+7.05\times10^6$$

Further, when $R_1$ in Expression 1 is replaced with $R_1$=r and the inclination of the γ value regarded as ideal allows the range within ±10%, the condition of the resistance value of the developing roller and the amount of charging of the toner having excellent gradation in contact development is determined as shown in the following expression:

$$r\times0.9\leqq R_1\leqq r\times1.1 \qquad \text{(Expression 2)}$$

The toner layer formed as a thin layer on the developing roller 5 is uniformly carried to a developing portion which is the portion opposed to the photosensitive drum 1.

In the developing portion wherein the developing roller 5 abuts against the photosensitive drum 1, the toner layer formed as a thin layer on the developing roller 5 develops the electrostatic latent image on the photosensitive drum 1 as a toner image by the DC voltage of the developing roller 5.

The undeveloped toner which has not been consumed in the developing portion is collected from the lower portion of the developing roller 5 with the rotation of the developing roller 5.

A seal member 17 comprising a flexible sheet is provided in this collecting portion, and permits the passage of the undeveloped toner into the developing container 14 and also prevents the toner 8 in the developing container 11 from leaking out from the lower portion of the developing roller 5.

This collected undeveloped toner on the developing roller 5 is scraped from the surface of the developing roller 5 in the abutting portion of the elastic roller 6 and the developing roller 5.

Most of the toner thus scraped is carried with the rotation of the elastic roller 6 and mixes with the toner 8 in the developing container 14, and the charges of the toner 8 are dispersed and at the same time, new toner is supplied onto the developing roller 5 by the rotation of the elastic roller 6, and the aforedescribed action is repeated.

Further, while in the first embodiment, the present invention has been used as a process cartridge holding the developing apparatus therein and detachably attachable to the main body of the image forming apparatus, the present invention may be used as a developing apparatus of such a construction that is fixed in the main body of the image forming apparatus and is supplied with only the toner, or may be used as a process cartridge holding the developing apparatus, the photosensitive drum, the cleaning blade, the waste toner containing container and the charging apparatus integrally therein and detachably attachable to the main body of the image forming apparatus.

As described above, according to the invention in the present embodiment, images of excellent gradation can be obtained in a contact monocomponent developing method of effecting development by bringing a developer layer carried on a developer carrying body into contact with a latent image bearing body.

What is claimed is:

1. A developing apparatus comprising:

a developer carrying body for carrying a developer thereon; and a layer thickness regulating member for regulating a layer thickness of the developer carried on said developer carrying body, the developer carried on said developer carrying body contacting with an image bearing body after the layer thickness thereof is regulated by said layer thickness regulating member;

wherein when a charge amount per 1 g of the developer after the layer thickness is regulated by said layer thickness regulating member and before the developer contacts with the image bearing body is defined as Q (μC/g) and an electrical resistance per axial length 1 mm of said developer carrying body is defined as R (Ω/mm), $$R\geqq0.9\times(-7.83\times10^4|Q|+7.05\times10^6)$$

and $$R\leqq1.1\times(-7.83\times10^4|Q|+7.05\times10^6)$$

are satisfied.

2. A developing apparatus according to claim 1, wherein said developer is a non-magnetic monocomponent developer.

3. A developing apparatus according to claim 2, wherein the volume resistance value of said developer is $10^{14}\Omega$ or greater.

4. A developing apparatus according to claim 2, wherein $SF_1$ of said developer is 100 to 180, and $SF_2$ of said developer is 100 to 140.

5. A developing apparatus according to claim 1, wherein said developer carrying body is an elastic roller having elasticity.

6. A developing apparatus according to claim 5, wherein said elastic roller has a silicone rubber layer, and acrylurethane resin coated on said silicone rubber layer.

7. A developing apparatus according to claim 1, wherein said layer thickness regulating member abuts against said developer carrying body.

8. A developing apparatus according to claim 7, wherein said abutting pressure is 25 g/cm to 35 g/cm.

9. A developing apparatus according to claim 1, wherein the charge amount of said developer is −40 $\mu$C/g to −20 $\mu$C/g.

10. A developing apparatus according to claim 9, wherein an amount of developer on said developer carrying body after the layer thickness is regulated by said layer thickness regulating member is 0.4 mg/cm$^2$ to 1.0 mg/cm$^2$.

11. A developing apparatus according to claim 9, wherein the layer thickness of the developer on said developer carrying body after the layer thickness is regulated by said layer thickness regulating member is 10 $\mu$m to 20 $\mu$m.

12. A developing apparatus according to claim 1, which is made into a unit with said image bearing body, and is detachably attachable to a main body of an image forming apparatus as a process cartridge.

* * * * *

UNITED STATES PATENT AND TRADEMARK OFFICE

CERTIFICATE OF CORRECTION

PATENT NO. : 6,308,038 B1
DATED : October 23, 2001
INVENTOR(S) : Tomomi Kakeshita et al.

It is certified that error appears in the above-identified patent and that said Letters Patent is hereby corrected as shown below:

Column 1,
Line 23, "etc." should read -- etc., --.

Column 2,
Line 19, "(μ C/g)" should read -- Q (μC/g) --.

Column 4,
Line 10, "which," should read -- which --;
Line 15, "adhered" should read -- is adhered --;
Line 20, "metal thin plats" should read -- metal thin plates --; and
Line 31, "and" should read -- and axially -- and "the axially" should read -- the --.

Column 5,
Line 15, "expressions" should read -- expressions, --;
Line 26, "becomes" should read -- changes --; and
Line 51, "monomers" should read -- monomers, --.

Column 7,
Line 24, "γ curve is" should read -- γ curve, -- and "γ value" should read -- γ value, --; and
Line 61, "(Expression 2)" should be deleted.

Column 8,
Line 10, "container 11" should read -- container 14 --.

Signed and Sealed this

Second Day of April, 2002

*Attest:*

*Attesting Officer*

JAMES E. ROGAN
*Director of the United States Patent and Trademark Office*